United States Patent [19]

Mixson

[11] 4,218,000

[45] Aug. 19, 1980

[54] PISTOL HOLSTER

[76] Inventor: Robert L. Mixson, 8016 W. 18th Ave., Hialeah, Fla. 33014

[21] Appl. No.: 963,895

[22] Filed: Nov. 27, 1978

[51] Int. Cl.[3] ..... F41B 13/04

[52] U.S. Cl. ..... 224/911; 224/193

[58] Field of Search ..... 224/192, 193, 198, 238, 224/232, 243, 911, 912

[56] References Cited

U.S. PATENT DOCUMENTS

| | | | |
|---|---|---|---|
| 3,420,420 | 1/1969 | Clark | 224/911 |
| 3,804,306 | 4/1974 | Azurin | 224/193 |
| 3,955,724 | 5/1976 | Perkins | 224/243 |
| 4,035,902 | 7/1977 | Bianchi et al. | 224/193 |

*Primary Examiner*—Robert J. Spar

*Assistant Examiner*—Kenneth Noland

*Attorney, Agent, or Firm*—Barry L. Haley

[57] ABSTRACT

An open-front, belt-mounted holster for a weapon such as a pistol, revolver, or the like, the holster compartment having a raised barrier wall forming the base of the front opening to retard or prevent unauthorized or accidental withdrawal of a pistol disposed therein. A releasable safety strap is mounted across the top of the front opening, the strap having a snap buckle mounted on the belt attaching side panel of the holster. The safety strap includes a rigid lever rising above the holster for quick thumb release of the snap. A rear strap joins the compartment panels and in conjunction with the front safety strap act to more firmly hold the weapon in the compartment.

7 Claims, 6 Drawing Figures

PISTOL HOLSTER

BACKGROUND OF THE INVENTION

This invention relates generally to a holster for a weapon such as a pistol or revolver, which has an open front for quick draw. The holster acts to firmly retain the weapon when not in use, but also provides for quick draw of the weapon when essential. The "open front" holster for a revolver is known in the art and is utilized to provide for a fast draw capability. The opening in the front of the holster compartment allows a weapon disposed therein to be manipulated in such a manner that the barrel can be quickly disposed through the front opening of the holster. However, for safety, the holster must also protect the bearer of the weapon from either an accidental or an unauthorized withdrawal such as when another person tries to take the weapon away from the bearer.

The present invention provides a barrier at the base of the front opening of the holster compartment that engages the end portion of the gun barrel of a weapon (in the stowed position) in the holster to prevent accidental or unauthorized removal of the weapon, the barrier being used in conjunction with the top and back safety straps to firmly hold the weapon in place.

BRIEF DESCRIPTION OF THE INVENTION

An improved holster for a hand held gun such as a pistol or revolver comprising first and second somewhat flexible panels made of leather or the like, said panels being joined along a back side and bottom by fillers to form a compartment. The major length of the front of the holster compartment is open, except that a relatively short filler forms a barrier at the bottom end of the open front.

The side panels are further joined along the holster upper front opening by a releasable strap which includes a raised vertical tab having a rigid member which is utilized as a thumb break. One of the side panels includes a rigid belt loop for attaching the holster to the bearer's belt, the belt loop being shaped to position the holster somewhat away from the body of the bearer to facilitate access to the holster even if the bearer is wearing a short jacket or the like. The front safety strap which joins the upper front portions of the side panels has a snap buckle which is disposed on the side of the belt loop mount.

The rear of the holster includes an upper open area between the panels and a strap permanently affixed to both panels across the upper open area at the rear of the holster. The rear strap allows the panels to spread more easily when the front strap is released while firmly holding the panels together when the front strap is secured.

The utilization of the front filler at the base of the front panel opening in conjunction with the upper front restraining strap (which does not engage the hammer of the weapon) and the rear restraining strap act to firmly and snuggly hold the weapon in the holster when it is not in use for greater security and safety, while still permitting for an expeditious withdrawal of the weapon when necessary.

The side panels of the holster include a molded, semi-cylindrical recess (formed to contour with the revolving cylinder of the weapon) on each side to restrict movement of the weapon within the compartment.

The fillers connecting the side panels are joined adhesively and stitched. The front barrier is raised approximately 10 to 20 percent above the bottom of the holster relative to the length of the open front. The front bottom filler provides a sufficiently raised barrier across the front opening to prevent the end tip of the barrel of the gun from being inadvertently rotated through the front opening. The front barrier acts in conjunction with the front and rear straps to provide a snug, firm restraint on a weapon in the holster compartment. With the safety strap released, the compartment restraints do not impede fast withdrawal of the weapon. The upper restraining strap that bridges the top opening between the two panels in the front is permanently fixed on one side panel and includes a releasable snap that is thumb actuated on the belt mounting side of the holster. The safety strap thumb break includes a rigid tab that rises above the snap and the top surface of the holster to provide a positive lever action when the thumb engages the tab for releasing the snap.

The rear strap across the opening in the rear of the holster at the top is permanently affixed to both panels.

In operation, the holster provides for quick withdrawal with a front break or front opening, while at the same time providing secure retention of the weapon disposed therein, when not in use. The position of the front and rear straps (which firmly hold the sides of the panel against the weapon) and the front opening barrier at the bottom which engages the barrel tip preventing unauthorized rotation of the barrel through the front opening, act in union to provide a secure compartment for retaining the weapon.

The rigid belt loop is shaped to provide a space between the inside panel of the holster and the bearer's waist to facilitate release of the thumb break and to accommodate a short jacket.

It is an object of this invention to provide an improved holster for a revolver or pistol which more firmly holds the piston in the holster when the weapon is not in use, while not impeding quick withdrawal when necessary.

It is another object of this invention to provide a holster having an open front design which allows for quick withdrawal of the weapon while still providing extreme safety and security for retaining the weapon firmly in the holster.

It is another object of this invention to provide a safety restraining strap which is actuated by the thumb which is positioned on the inside (belt mount side) of the holster.

In accordance with these and other objects which will be apparent hereinafter, the instant invention will now be described with particular reference to the accompanying drawings.

PREFERRED EMBODIMENT OF THE INVENTION

Figure 1:
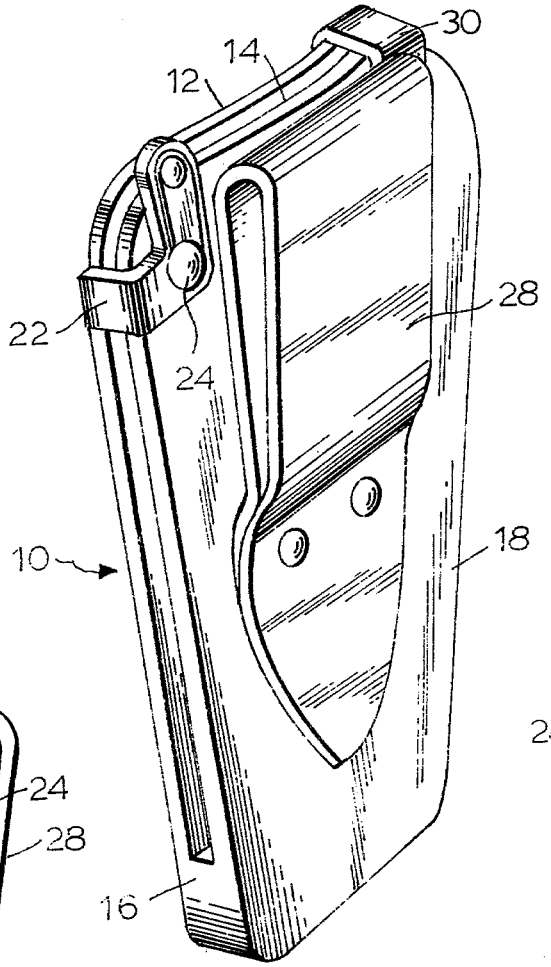
FIG. 1 shows a perspective view of the instant invention.

Referring now to the drawings and specifically FIG. 1, the instant invention is shown generally at 10 showing a revolver holster comprised of a first somewhat flexible panel 12 joined to a second flexible panel 14 by a bottom filler 16 and a back wall filler 18. The fillers act as panel spacers. The first and second panels, 12 and 14, may be of two-ply construction and sewn together and may be made of a natural or artificial material, either leather, plastic, or the like. The bottom filler 16 and the back wall filler 18 may be constructed of leather and may be adhesively affixed joining the side panels together to form a holster compartment. Each of the side panels 12 and 14 has a molded interior area 20 which receives the cylindrical chamber of a revolver for a more snug and firm fit.

Connected across the upper front opening is a strap 22 which has a female snap buckle fitting 24 connected to a male buckle fitting 26 affixed to panel 14. The thumb-actuated strap 22 has the snap buckle located on the same panel that includes a belt receiving loop 28 such that the thumb break 30 is located nearer to the carrier person's body.

The back filler 18 of the holster stops short of the top back panels of the holster such that a relatively shorter back opening is presented which is bridged permanently by strap 30 is located across the back of the holster connecting the panels together at the upper back. The rear strap attachment allows some pivotal, inward movement of the panels as the front of the compartment is spread open, while limiting lateral separation at all times.

Figure 2:
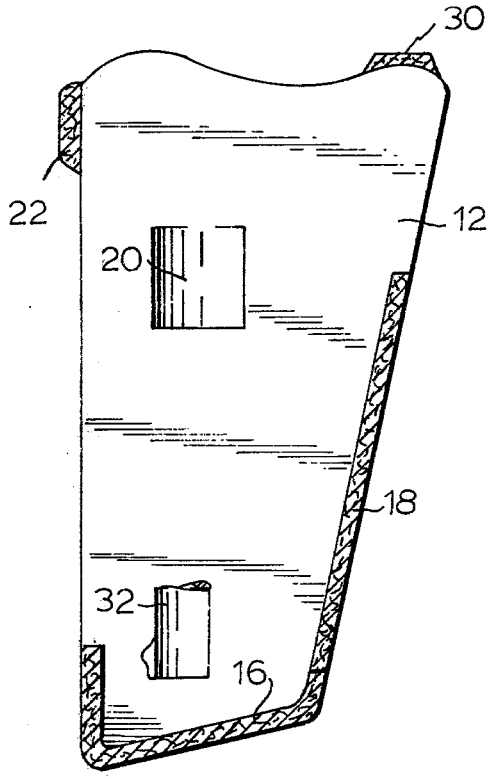
FIG. 2 shows a side elevational view partially in cross-section of the instant invention.
Figure 3A:
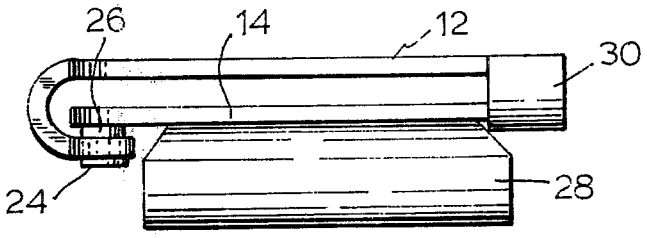
FIG. 3*a* shows a top plan view of the instant invention.
Figure 3B:
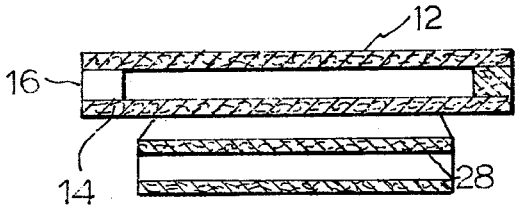
FIG. 3*b* shows a top plan view in cross-section through line I—I in FIG. 2.

Referring now to FIG. 2, the front, filler wall **16*a* is shown which rises above the bottom of the holster compartment in the front forming a barrier which can restrain the end barrel tip of the revolver, preventing its accidental or unauthorized pivotal movement through the front opening of the holster. The filler 16*a* height is sufficient up the front to engage a conventional revolver barrel tip mounted therein. Thus, as shown in FIGS. 2, 3*a*, and 3*b***, in order for the barrel to be thrust through the front opening of the holster, a weapon would have to be raised slightly in the holster compartment.

Figure 4:
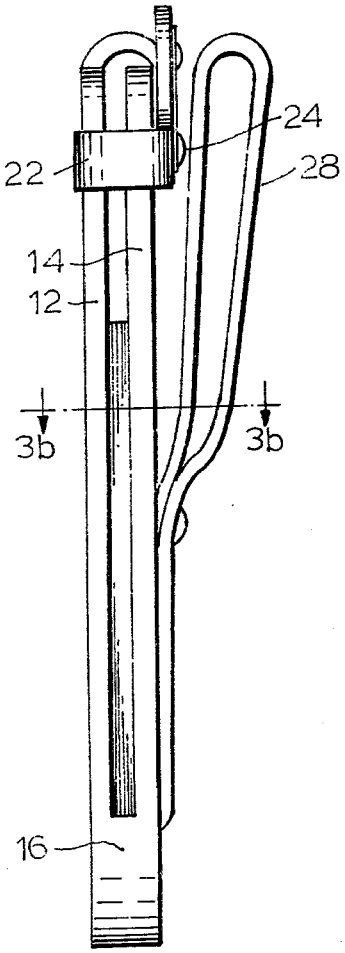
FIG. 4 shows a front elevational view of the instant invention.

FIG. 4 shows front safety strap 22 construction with the rigid strip 32 fixed to the outside of the leather strap 22 above the snap 24. The thumb break release is raised above the top edge of the panel of the holster to allow quick engagement by the thumb.

Figure 5:
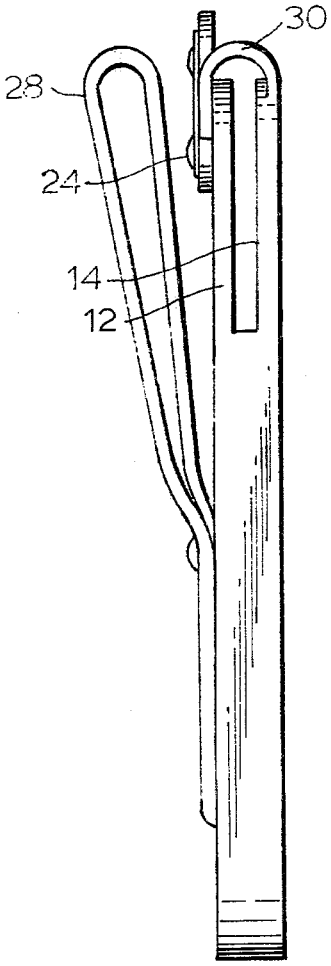
FIG. 5 shows a rear elevational view of the instant invention.

FIGS. 4 and 5 show the lateral separation of the belt loop 28 which is rigid from the panel 14 to facilitate hand access to the holster when a short jacket is worn and to allow sufficient space to actuate thumb break to release strap 22.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An open front holster for a pistol, revolver, or the like comprising:

first and second panels of a somewhat flexible material, each of said panels having a front, a rear, a top, and a bottom edge;

a belt attaching means affixed to one of said panels on the outside;

a filler connected between a substantial portion of the bottom and rear edges of said first and second panels joining said first and second panels together, the first and second panels in conjunction with the filler forming a compartment for receiving said pistol or revolver;

a barrier wall connected between the bottom, front edges of said first and second panels, disposed below the front opening between said first and second panels, said barrier wall extending slightly above the bottom of said compartment for engaging the barrel end of a pistol or revolver resting in said compartment to prevent said barrel end from rotating through said opening from said pistol rest portion;

a rear strap connecting said first and second panels along the upper rear edge of said holster; and means for releasably connecting said first and second panels together at the upper front edges of said first and second panels.

2. A holster in claim 1, wherein:

said releasable connecting means includes a front strap connecting said first and second panels across said front opening, said front strap being disposed near the top of said first and second panels.

3. A holster as in claim 2, wherein:

said front strap includes a thumb actuated snap connected to said panel and said strap, said panel having said snap including the belt mounting loop.

4. An open front, belt-mounted holster for a weapon such as a pistol, or revolver, the holster being useful for preventing unauthorized or accidental withdrawal of the weapon disposed therein, the holster comprising:

a pair of side panels substantially parallel and of the same peripheral configuration, each of said side panels being somewhat flexible, each of said side panels having a front edge and a rear edge, and a top edge and a bottom edge forming front and rear, and upper and lower corners;

a first filler connected between said panels along the rear edges of the panel from the bottom, rear corners of the panels, said first filler forming a rear wall of said holster commencing from the bottom rear corners of said panels, said first filler terminating prior to reaching the upper, rear corners of said panels;

means connecting the panels together at the upper rear corner connected between each panel;

a releasable means connecting the upper front corners of said panels together connected to each of said panels;

a barrier wall connected between said panels commencing at the bottom front corners of said panels upwardly and terminating a distance above said bottom edges of said panels, a distance sufficient to engage the barrel end of a pistol or revolver disposed within the holster and pivoted from its rest position in said holster, said barrier wall being sized so that slightly raising said weapon from its rest position in the holster will allow it to be drawn through the front opening of the holster.

5. A holster as in claim 4, wherein:

said means for connecting said side panels together at the upper front corner includes a front strap anchored at one end to one of said panels and disposed across the front opening between said panels, a snap being connected on one of said panels on the opposite end of said strap.

6. A holster as in claim 5, wherein:

said front barrier is disposed between 10 to 20 percent of the distance along the front of said holster from the bottom of said holster.

7. A holster as in claim 5, wherein:

said means for connecting said panels together along the upper rear corner is a permanently mounted strap connected at each end to said panel.

* * * * *